US009223291B2

(12) United States Patent
Cusin et al.

(10) Patent No.: US 9,223,291 B2
(45) Date of Patent: Dec. 29, 2015

(54) ONE-PIECE COMPOSITE IMPULSE PIN-SAFETY ROLLER COMPONENT

(71) Applicant: Nivarox-FAR S.A., Le Locle (CH)

(72) Inventors: Pierre Cusin, Villars-Burquin (CH); Raphael Garret, La Chaux-de-Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/662,439

(22) Filed: Mar. 19, 2015

(65) Prior Publication Data

US 2015/0268631 A1 Sep. 24, 2015

(30) Foreign Application Priority Data

Mar. 24, 2014 (EP) ..... 14161282

(51) Int. Cl.
*G04B 15/14* (2006.01)
*G04B 15/08* (2006.01)
*G04B 17/06* (2006.01)

(52) U.S. Cl.
CPC ..... *G04B 15/14* (2013.01); *G04B 15/08* (2013.01); *G04B 17/063* (2013.01)

(58) Field of Classification Search
CPC ..... G04B 15/06; G04B 15/08; G04B 15/14; G04B 17/063; G04B 17/32
USPC ..... 368/129–132
See application file for complete search history.

(56) References Cited

U.S. PATENT DOCUMENTS

| | | | | |
|---|---|---|---|---|
| 3,678,683 | A * | 7/1972 | Cielaszyk | G04B 15/14 368/133 |
| 3,791,251 | A * | 2/1974 | Pohlmann | G04B 17/063 368/130 |
| 3,826,076 | A * | 7/1974 | Tuetey | G04B 15/08 368/129 |
| 2009/0168611 | A1 * | 7/2009 | Gigandet et al. | G04B 17/06 368/130 |
| 2010/0208555 | A1 | 8/2010 | Hiraoka et al. | |
| 2012/0307601 | A1 | 12/2012 | Kruttli | |

FOREIGN PATENT DOCUMENTS

| | | |
|---|---|---|
| CH | 12 666 | 5/1897 |
| EP | 2 075 652 A1 | 7/2009 |
| FR | 1 316 624 | 2/1963 |
| WO | WO 2011/121432 A1 | 10/2011 |

OTHER PUBLICATIONS

European Search Report issued Dec. 2, 2014 in European Application 14161282, filed on Mar. 24, 2014 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

The invention relates to a one-piece composite micromechanical timepiece component including a first functional level including an impulse pin made of a first material arranged to cooperate with a member, the first functional level also including an electroformed portion made of a second metallic material partially overlapping the impulse pin and a second functional level including only the electroformed portion forming a roller also arranged to cooperate with the member.

11 Claims, 2 Drawing Sheets

ONE-PIECE COMPOSITE IMPULSE PIN-SAFETY ROLLER COMPONENT

This application claims priority from European Patent Application No. 14161282.0 filed Mar. 24, 2014, the entire disclosure of which is incorporated herein by reference.

FIELD OF THE INVENTION

The invention relates to a one-piece composite timepiece component and, more specifically, such a component intended to replace a safety roller-roller table-impulse pin assembly.

BACKGROUND OF THE INVENTION

In Swiss lever escapement systems, it is known to use a double roller-impulse pin assembly as illustrated in FIG. 1. This assembly includes a roller table B which carries an impulse pin A and a safety roller C with a notch E which works with the guard-pin of pallets. Impulse pin A is fixed underneath the roller table B and works with the fork of the same pallets.

In addition to the significant height of the double roller-impulse pin assembly, it is also difficult to position impulse pin A correctly relative to notch E of safety roller C.

SUMMARY OF THE INVENTION

It is an object of the present invention to overcome all or part of the aforecited drawbacks by proposing a component, as an alternative to the double roller-impulse pin assembly, which is more compact and more precise with no tribological deterioration.

To this end, the invention relates to a one-piece composite micromechanical timepiece component including a first functional level including an impulse pin made of a first material arranged to cooperate with a member, the first functional level also including an electroformed portion made of a second metallic material partially overlapping the impulse pin and a second functional level including only the electroformed portion forming a roller arranged also to cooperate with the member, the first material being different from the second metallic material.

Advantageously according to the invention, it is thus possible to uncouple the mainly tribological function of the impulse pin from the main attachment function of the electroformed portion by selecting a material that adapts perfectly to its own function. Moreover, compared to a double roller-impulse pin assembly, it is immediately evident that the component according to the invention is much more compact with no loss in the quality of attachment or the tribology of the impulse pin while ensuring better positioning between the levels and the functions.

In accordance with other advantageous features of the invention:

- the impulse pin includes a lug not covered by the electroformed portion that narrows to a base from which at least two strips extend substantially symmetrically, partially covered by the electroformed portion;
- the at least two strips of the impulse pin each extend in an arc of a circle;
- the first and second functional levels are traversed by a single hole;
- the single hole includes a circular cross-section;
- the cross-section of the single hole is substantially constant for each of the first and second functional levels or is different in each of the first and second functional levels in order to adjust the component in both planes or only in the plane of one of the first and second functional levels;
- the wall of the component surrounding the single hole is formed solely by the electroformed portion;
- the first material is formed of doped or undoped single crystal silicon, doped or undoped polycrystalline silicon, silicon oxide, quartz, silica, single crystal corundum, polycrystalline corundum, alumina, ruby, silicon nitride, silicon carbide;
- the first material is at least partially coated with silicon oxide, silicon nitride, silicon carbide or an allotrope of carbon.

Finally, the invention relates to a timepiece assembly including a sprung balance resonator assembly mounted on an arbor, characterized in that the assembly further includes a one-piece composite micromechanical component, according to any of the preceding variants, mounted on the arbor by being driven against the electroformed portion, and arranged to cooperate with an escapement system.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 2:
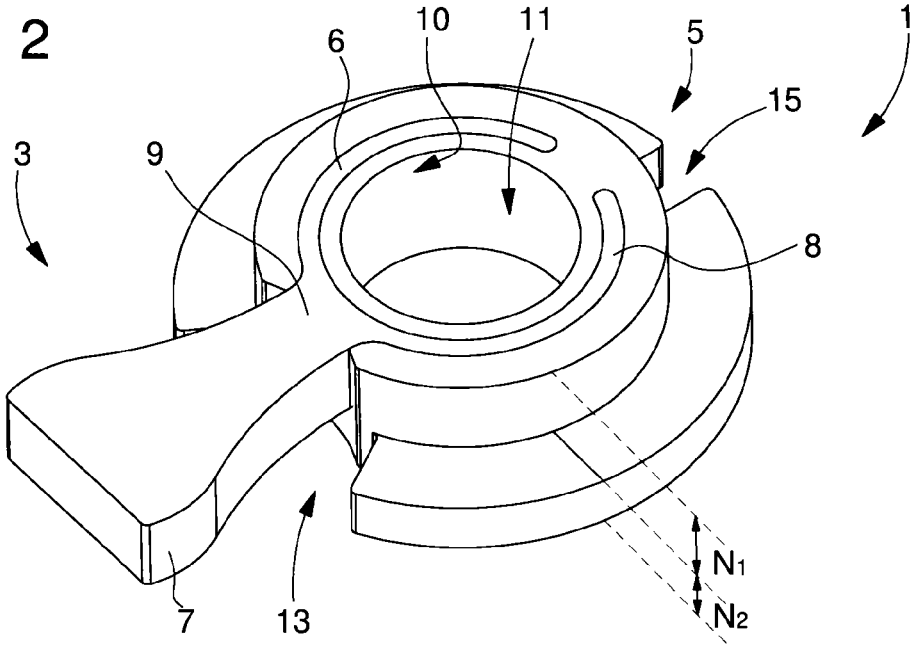
FIG. 2 is a perspective view of a one-piece composite component according to the invention.

The invention relates to a one-piece composite micromechanical timepiece component 1, i.e. including several distinct materials, namely of a different nature and secured to each other. As illustrated in FIG. 2, component 1 preferably includes at least two distinct functional levels $N_1$, $N_2$.

Thus, a first functional level $N_1$ includes an impulse pin 3 made of a first material arranged to cooperate with a member, such as pallets' fork. The first functional level $N_1$ also includes an electroformed portion 5 made of a second metallic material. It is immediately evident that portion 5 is made integral since it is electroformed on top of impulse pin 3 during an electroforming process. Consequently, electroformed portion 5 partially overlaps impulse pin 3.

Figure 1:
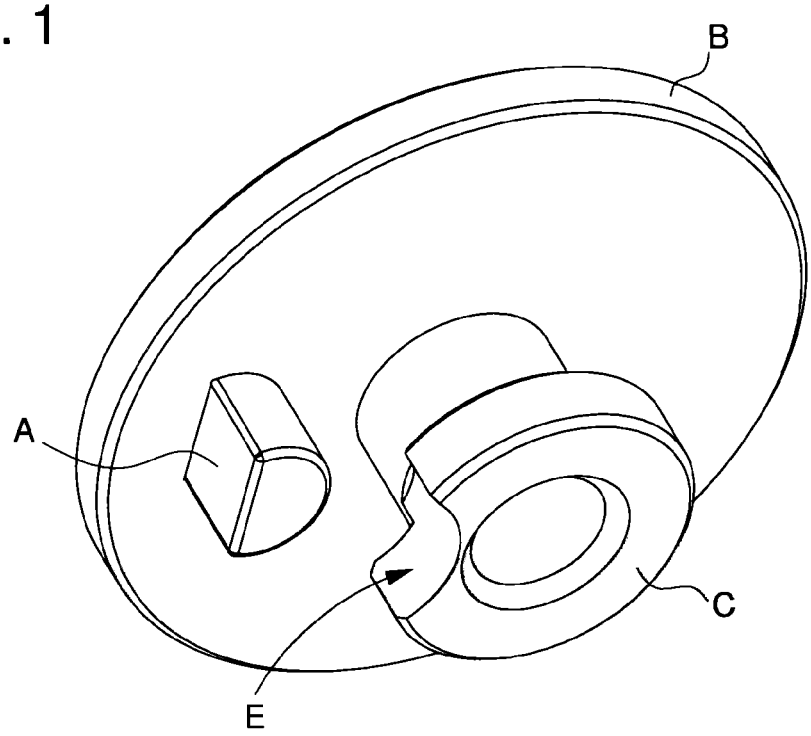
FIG. 1 is a perspective view of an ordinary double roller-impulse pin assembly.

As illustrated in FIG. 2, component 1 includes a second functional level $N_2$ including only electroformed portion 5 forming a roller also arranged to cooperate with the same member, such as the guard-pin of pallets. It is immediately apparent that the component thereby formed is much more compact than the double roller-impulse pin assembly illustrated in FIG. 1. Moreover, since portion 5 is electroformed on top of impulse pin 3 during an electroforming process, the positioning between each level $N_1$, $N_2$ is intrinsically very accurate.

Preferably, impulse pin 3 includes a lug 7 not covered by electroformed portion 5. As illustrated in FIG. 2, the free end of lug 7 narrows to a base 9 from which at least two strips 6, 8 extend substantially symmetrically, partially covered by electroformed portion 5.

Of course, base 9 and/or strips 6, 8 could alternatively be entirely covered by electroformed portion 5. Indeed, for improved viewing of impulse pin 3 in FIG. 2, the top portion thereof has not been covered by electroformed portion 5.

As seen in FIG. 2, said at least two strips 6, 8 of impulse pin 3 each extend in an arc of a circle but do not meet so as to allow a certain elasticity of the first material with respect to the second metallic material.

The first and second functional levels $N_1$, $N_2$ are, preferably according to the invention, traversed by a single hole 11 so as to allow, for example, an arbor or a pin to be fitted therein. In the example illustrated in FIG. 2, the single hole 11 includes a circular cross-section. It is understood, however, that other cross-sectional shapes can also be envisaged such as a clover leaf, polygon or ellipsis.

Moreover, according to a first alternative, the cross-section of single hole 11 is substantially constant for each of the first and second functional levels $N_1$, $N_2$ so as to adjust component 1 in the two planes of the first and second functional levels $N_1$, $N_2$.

However, according to a second alternative, the cross-section of single hole 11 is different in each of the first and second levels N1, $N_2$ so as adjust component 1 preferably in the plane of one of the first and second functional levels $N_1$, $N_2$.

Finally, the wall 10 of component 1 surrounding single hole 11 is formed solely by electroformed portion 5 in order to permit component 1 to be driven for example against an arbor or a pin. It is clear then that electroformed portion 5 is plastically deformed to secure one-piece component 1 against, for example, an arbor or a pin. Advantage is also taken of the ability of said at least two strips 6, 8 of impulse pin 3 to allow a sufficient elasticity in order to follow the deformation of wall 10.

Advantageously according to the invention, it is thus possible to uncouple the mainly tribological function of impulse pin 3 from the main attachment function of electroformed portion 5. It can also be seen that electroformed portion 5 forms at second level $N_2$ two notches 13, 15, notch 13 may have the same function as notch E of the ordinary double roller-impulse pin assembly, that is to say, for example, cooperating with a guard-pin of pallets.

Thus, the first material of impulse pin 3 may be formed of doped or undoped single crystal silicon, doped or undoped polycrystalline silicon, silicon oxide, quartz, silica, single crystal corundum, polycrystalline corundum, alumina, ruby, silicon nitride or silicon carbide. The first material may even be at least partially coated, particularly at lug 7, with silicon oxide, silicon nitride, silicon carbide or an allotrope of carbon in order to improve its tribology. Finally, by way of example, electroformed portion 5 made of metallic material may include nickel, a nickel-cobalt alloy or a nickel-phosphorus alloy.

Figure 3:
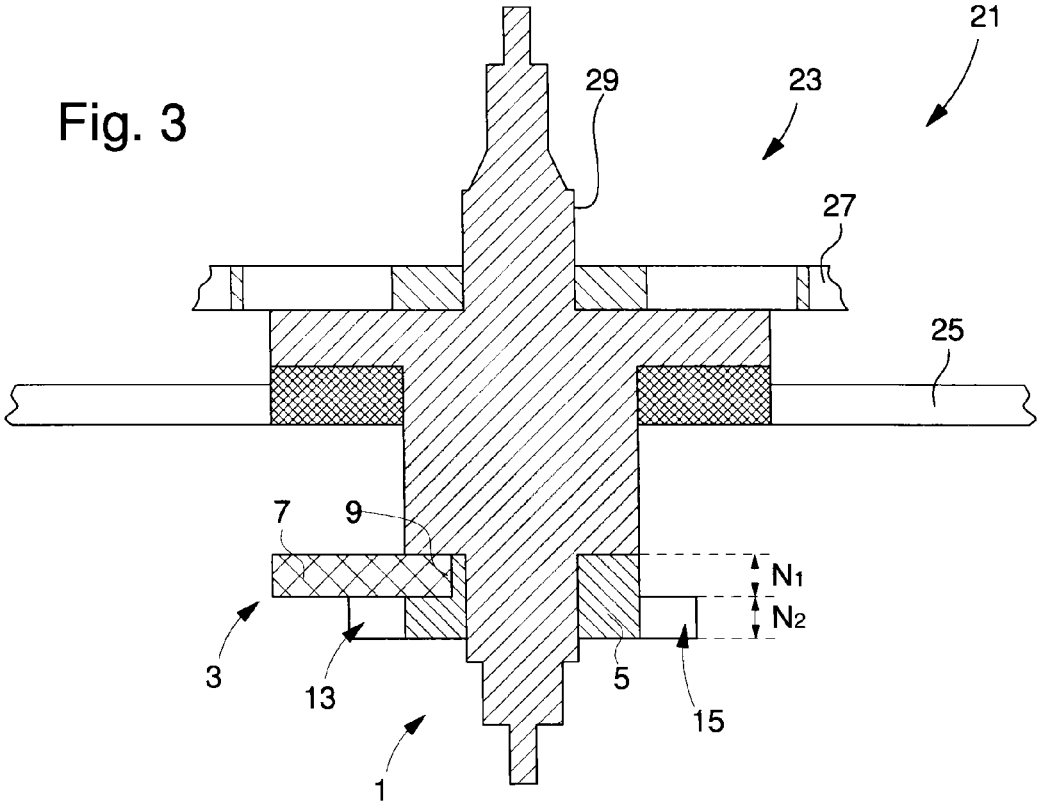
FIG. 3 is a cross-section of a timepiece assembly according to the invention.

As illustrated in FIG. 3, the invention also concerns a timepiece assembly 21 including a resonator 23 with a balance 25—balance spring 27 assembly mounted on an arbor 29. Assembly 21 further includes a one-piece composite micromechanical component 1 according to the invention which is mounted on arbor 29 in order, for example, to cooperate with a Swiss lever escapement system.

Of course, this invention is not limited to the illustrated example but is capable of various variants and alterations that will appear to those skilled in the art. In particular, component 1 may include more than two functional levels $N_1$, $N_2$.

It is also possible to envisage that hole 11 is open, that is to say it includes a slot, for example, in the direction of notch 15 so that component 1 can be elastically mounted on an arbor or a pin.

What is claimed is:

1. A one-piece composite micromechanical timepiece component including a first functional level including an impulse pin made of a first material arranged to cooperate with a member, the first functional level also including an electroformed portion made of a second metallic material partially overlapping the impulse pin and a second functional level including only the electroformed portion forming a roller also arranged to cooperate with the member, the first material being different from the second metallic material.

2. The component according to claim 1, wherein the impulse pin includes a lug not covered by the electroformed portion that narrows to a base from which at least two strips extend substantially symmetrically, partially covered by the electroformed portion.

3. The component according to claim 2, wherein the at least two strips of the impulse pin each extend in an arc of a circle.

4. The component according to claim 1, wherein the first and second functional levels are traversed by a single hole.

5. The component according to claim 4, wherein the single hole includes a circular cross-section.

6. The component according to claim 4, wherein the cross-section of the single hole is substantially constant for each of the first and second functional levels.

7. The component according to claim 4, wherein the cross-section of the single hole is different in each of the first and second functional levels in order to adjust the component only in the plane of one of the first and second functional levels.

8. The component according to claim 4, wherein the wall of the component surrounding the single hole is formed solely by the electroformed portion.

9. The component according to claim 1, wherein the first material is formed of doped or undoped single crystal silicon, of doped or undoped polycrystalline silicon, of silicon oxide, of quartz, of silica, of single crystal corundum, of polycrystalline corundum, of alumina, of ruby, of silicon nitride, or of silicon carbide.

10. The component according to claim 1, wherein the first material is at least partially coated with silicon oxide, with silicon nitride, with silicon carbide or with an allotrope of carbon.

11. A timepiece assembly including a resonator having a balance—balance spring assembly mounted on an arbor wherein the timepiece assembly further includes a one-piece composite micromechanical component according to claim 1, which is mounted on the arbor by being driven against the electroformed portion, and arranged to cooperate with an escapement system.

* * * * *